US005092508A

United States Patent [19]

Vigil Rio

[11] Patent Number: 5,092,508

[45] Date of Patent: Mar. 3, 1992

[54] COMPRESSED AIR NAIL MACHINE

[76] Inventor: Amaro Vigil Rio, Cervantes No. 2-6º D., Oviedo, Asturia 33004, Spain

[21] Appl. No.: 613,271

[22] Filed: Nov. 14, 1990

[51] Int. Cl.[5] ..... B27F 7/02

[52] U.S. Cl. ..... 227/14; 227/130; 227/156

[58] Field of Search ..... 227/14, 78, 48, 130, 227/132, 156, 118

[56] References Cited

U.S. PATENT DOCUMENTS

| | | | |
|---|---|---|---|
| 3,386,639 | 6/1968 | Unger | 227/14 |
| 3,595,460 | 7/1971 | Pitkin | 227/48 |
| 3,847,321 | 11/1974 | Charlez | 227/130 |
| 4,146,339 | 3/1979 | Fleming et al. | 227/14 |

FOREIGN PATENT DOCUMENTS

| | | | |
|---|---|---|---|
| 3114337 | 11/1982 | Fed. Rep. of Germany | 227/14 |
| 891438 | 12/1981 | U.S.S.R. | 227/14 |

*Primary Examiner*—Frank T. Yost
*Assistant Examiner*—Scott A. Smith
*Attorney, Agent, or Firm*—Merchant, Gould, Smith, Edell, Welter & Schmidt

[57] ABSTRACT

An improved compressed air nail machine is disclosed incorporating a plastering device for automatically filling the hole above each nail head after it is placed into the wood. The plastering device adapts to a conventional nail gun and comprises a piston and cylinder pair which utilizes the exhaust air originating from the nail gun. The reciprocating motion of the piston and cylinder causes a quantity of wax feed into an orifice located in the side wall of the cylinder to be expelled through an orifice in the bottom of cylinder and into the nail hole. The recuperation of the piston in the cylinder is due to the fact that in the lateral surface of said cylinder exists an orifice through which air is expelled once this orifice is surpassed by the piston, so that by means of an internal spring, the initial position of the piston is achieved. The wax is shaped as a bar and a pre-determined portion is utilized in each plastering action and is able to be regulated by the change of the piston route, the diameter of the exit orifice, the bulk of the same, etc. The device is interchangeable so that the most convenient one can be utilized in each case, according to the type and size of the nails that are utilized.

3 Claims, 2 Drawing Sheets

FIG. 2
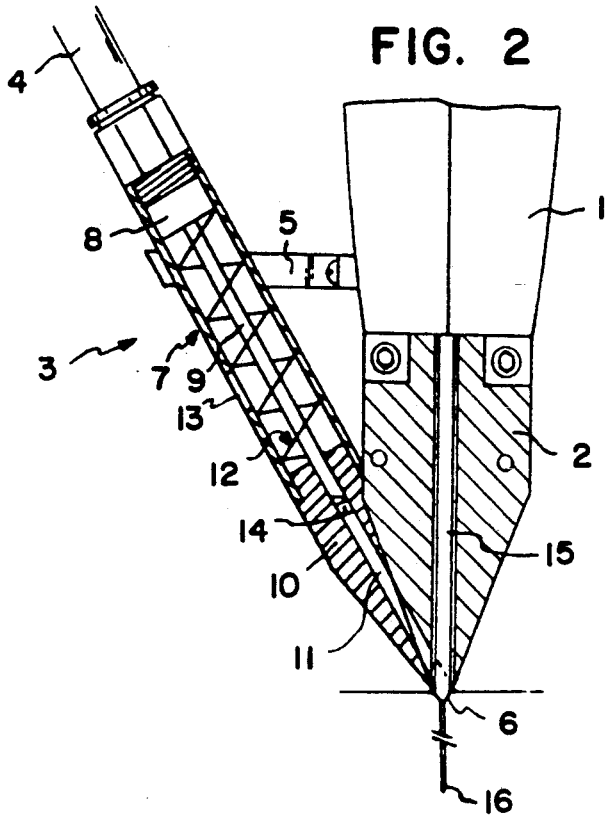
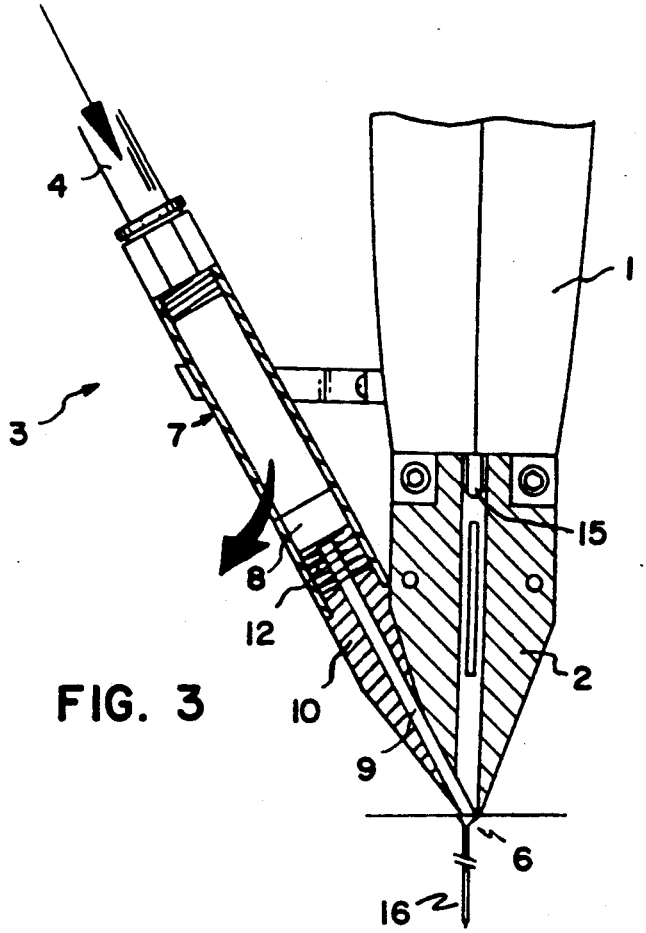
FIG. 3

COMPRESSED AIR NAIL MACHINE

BACKGROUND OF THE INVENTION

1. Field of the Invention

This invention relates to improvements in a compressed air nail machine used in carpentry, building, etc.

2. Description of Related Art

When a carpenter places a nail in wood (doors, furniture, etc.), it is often necessary to plaster the nail hole afterward. Typically, this operation is done manually and wastes a considerable amount of time. At the same time the plastering is not always uniform, because by being done manually, there is no way of knowing precisely the exact amount of wax needed to cover each hole. This is why often too much wax is used or not enough wax is used. Therefore, when the plastering of nails is done manually, one by one, it is very laborious and does not always provide the correct finish.

SUMMARY OF THE INVENTION

The present invention resolves this problem with complete satisfaction and makes the process easier. As compared with conventional methods, the improvement provided by the present invention consists of incorporating into a conventional nail gun a device by which this operation can be done automatically and which regulates the plastering of each of the nails placed in the wood by the nail gun.

The present invention comprises a device which is found in the nail machine and is composed of a cylinder activated by the remaining air originating in the functioning of the nail machine, so that this activity takes with it the movement towards the outside of the piston, bringing along a quantity of wax that, obviously, is found stored in the cylinder. Duly shown is the exit of the device at the point of the exit of the nails from the nail gun. Once the nail is placed in the wood, the cylinder is immediately activated, and with it, the movement of the wax that will be deposited over the nail hole.

The recuperation of the piston of said cylinder is due to the fact that in the lateral surface of such exists an orifice through which air goes through once this orifice is surpassed by the piston, so that by means of an internal spring, the initial recuperation is attained from the piston, making it ready to do the process over again.

The wax is shaped as a bar and a predetermined portion is utilized in each plastering action and is able to be regulated by the change of the piston route, the diameter of the exit orifice, the bulk of the same, etc.

The device is interchangeable so that the most convenient one can be utilized in each case, according to the type and size of the nails that are utilized.

BRIEF DESCRIPTION OF THE DRAWINGS

To facilitate the description of the operation of the present invention and with the purpose of providing a better understanding of the characteristics of the invention, the following description is based on a set of drawings accompanying the specification, in which they are used to orient and limit what is represented by the following.

In FIG. 2, a detailed view of the actuator of the compressed air nail gun is shown with the plaster device sectioned and in a inoperative position.

In FIG. 3, a view of the same detail as represented in FIG. 2 is shown, but with the plaster device in an operative position.

DETAILED DESCRIPTION OF THE PREFERRED EMBODIMENT

Figure 1:
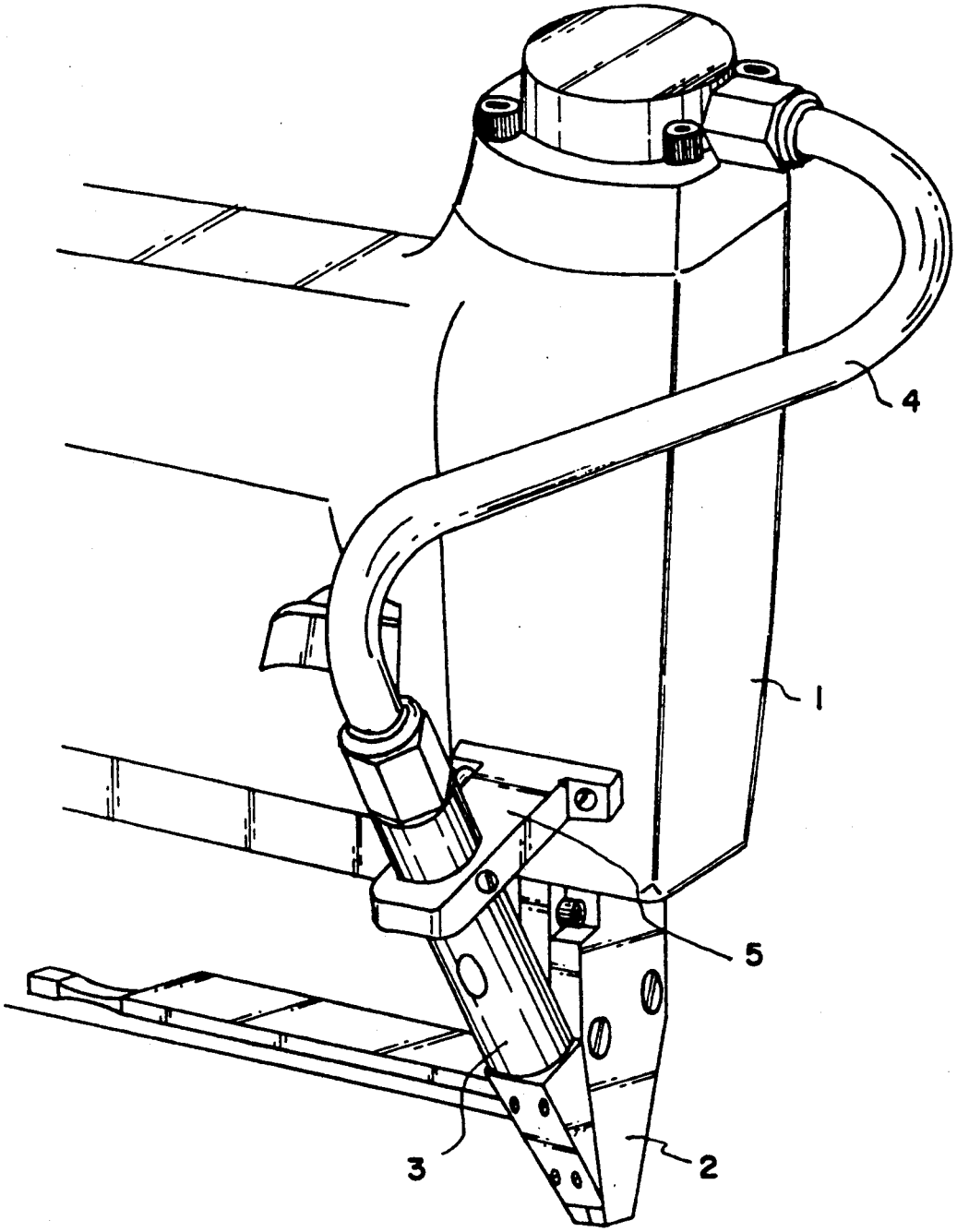
In FIG. 1, a general perspective of the compressed air nail gun with a plaster device is shown which constitutes the major object of the invention.

As seen in FIG. 1, the nail machine (1) incorporates a plaster device (3), feeding exhaust air through a pipe (4) for activation of the device. The device is mounted on the side of the nail machine (1), by a support (5), leaving the device (3) oriented at an inclination to the head (2) of the nail machine and directed towards the exit point (6) of the head (2).

The plaster device (3) consists of a cylinder (7) and a piston (8) located in the interior thereof, with an axial bar (9), which travels through the cylinder (7). The cylinder (7) is joined at one end by an axial piece (10) which contains an orifice (11) through which the bar of wax is passed. The exit point of the orifice (11) is situated in correspondence with the exit point (6) of the head (2) of the compressed air nail machine (1). Inside the device (3), between the piston (8) and the axial piece (10), is situated a spring (12); while laterally the cylinder (7) has an orifice (13). The introduction of the wax into the axial piece (10) is realized laterally, through the existing piece (10) and orifice (14) for the exit of such wax towards the orifice or hole (11).

The operation of the plaster device (3) will now be described. When the nail machine (1) is made to function, the blade (15) is lowered and forces the respective nail (16) into the wood. The blade (15) then tends to go back to its original settled position. At this moment, the nail machine (1) expulses the air that it needed to force out the nail. Accordingly, the air is then used to activate the device (3), penetrating the cylinder (7) of such through the pipe (4), which is joined to an exit point for the air from the nail gun (1). The exhausted air pushes the piston (8) against the action of the spring (12), which causes the rod (9) to push out a small portion of the wax through the orifice (14), and forcing the wax through the orifice (11]so that the hole is covered and the nail (16) cannot be seen. When the piston (8) is pushed down to the bottom of the cylinder (7), the air exits through the lateral hole (13) of the cylinder (7), and the piston returns to its first position by the action of the spring (12).

I claim:

1. A compressed air nail machine, comprising:

(a) a pneumatic source for providing air pressure;

(b) a nail gun for driving a nail having a pneumatic input orifice coupled to the pneumatic source and an exhaust orifice for exhausting an exhaust air; and (c) a plaster device, disposed adjacent to the nail gun and operatively coupled thereto, for dispensing a plaster filler into a cavity created by driving the nail, the plaster device including a reciprocating piston within a cylinder, the cylinder having a plaster input orifice for loading the plaster filler and resilient means therein for recuperating the piston to a pre-stroke position, the piston operatively coupled to the exhaust orifice of the nail gun and plunged by the exhaust air so that plaster is dispensed in response thereto at an exit point in the cylinder disposed above the cavity, the cylinder having a vent orifice disposed on a side wall of the cylinder so that the piston in a fully extended stroke, allows the exhaust air to vent through the vent orifice.

2. A compressed air nail machine as recited in claim 1, wherein the resilient means within the plaster device comprises a coil spring.

3. A plaster device for detachable mounting to a conventional pneumatic nail gun, comprising:

a pipe, coupled to an exhaust air flow from the nail gun, for supplying air pressure to stroke a piston within a cylinder;

the piston having an axial bar attached at a distal end and extending through and being coaxial with a spring means, the spring means being supported at a first end by an axial piece within the cylinder;

the cylinder having an exhaust orifice located on a distal sidewall so that the piston in a fully stroked position, compresses the spring means allowing the exhaust air to escape through the exhaust orifice, the spring means recuperating the piston within the cylinder after the exhaust air is expelled;

the axial piece on the cylinder having an orifice through which plaster is laterally feed in; and an exit orifice, located above an exit head on the nail gun, for dispensing plaster forced out by the axial piston bar.

* * * * *